US006189599B1

(12) United States Patent
Hanna

(10) Patent No.: US 6,189,599 B1
(45) Date of Patent: Feb. 20, 2001

(54) METHOD AND MACHINE FOR PRODUCING AN OPEN RISER IN A MOLD

(76) Inventor: Paul E. Hanna, 217 Boatmen Dr., Pawleys Island, SC (US) 29585

( * ) Notice: Under 35 U.S.C. 154(b), the term of this patent shall be extended for 0 days.

(21) Appl. No.: 09/247,683

(22) Filed: Feb. 9, 1999

(51) Int. Cl.[7] ..... B22C 9/08; B22C 15/02

(52) U.S. Cl. ..... 164/37; 164/207; 164/244; 164/359

(58) Field of Search ..... 164/15, 37, 244, 164/359, 360, 207

(56) References Cited

U.S. PATENT DOCUMENTS 3,273,211 * 9/1966 Miraldi ..... 164/359 X
4,640,333 * 2/1987 Martin et al. ..... 164/34 X
5,462,106 * 10/1995 Hanna ..... 164/359 X

* cited by examiner

*Primary Examiner*—J. Reed Batten, Jr.

(57) ABSTRACT

A method and machine for forming an open riser in a mold includes a resiliently compressible plug received into the upper end of a riser sleeve, which projects above the riser sleeve and cope sand level so as to be advanced into the riser sleeve during squeezing of the mold sand. The plug is fixed to the upper squeeze plate to be withdrawn from the riser sleeve as the squeeze plates are separated, creating an open riser.

4 Claims, 2 Drawing Sheets

METHOD AND MACHINE FOR PRODUCING AN OPEN RISER IN A MOLD

BACKGROUND OF THE INVENTION

This invention concerns metal casting using sand molds.

Sand molds are made by placing a pattern in the cope and flask cavities of a mold machine, injecting sand into the cavities, and thereafter squeezing the sand to compress the sand into a finished mold by raising a lower squeeze plate relative to an upper fixed squeeze plate.

A riser is often provided in the upper half of the mold to allow molten metal to enter the riser, during casting, the metal contained within the riser maintained in a liquid state by an insulating or exothermic sleeve in the riser. The volume of metal in the riser makes up for shrinkage in the mold cavity. It is sometimes desirable to have an "open" riser which extends to the outside of the mold so that additional melt can be added from the outside as necessary.

An open riser has been difficult to form into the mold at the time the mold is made due to the nature of the sand mold making process when using an automatic mold making machine since sand could be dislodged, which could then drop into the main cavity.

Thus, a separate cutting operation has been required to provide an open riser.

U.S. Pat. No. 5,462,106 issued on Oct. 31, 1995 to the present inventor describes and claims a method which uses a heat consumable plug mated with a riser sleeve.

The plug is tapered and inserted into the riser tube as the sand is compressed. The plug prevents sand from entering the riser tube when sand is injected, and maintains a seal by the plug being driven into riser tube as the sand is compressed.

While successful, this approach requires a plug of a size matched to the diameter of the riser tube to be assembled into the riser tube each time a mold is made.

It is the object of the present invention to provide a method of making an open riser opening in a sand mold at the time the mold is made in an automatic mold making machine which does not require the assembly of a properly sized heat consumable plug into the riser sleeve each time a mold is constructed.

SUMMARY OF THE INVENTION

The above recited object, as well as others which will become apparent upon reading of the following specification and claims, are achieved by fixedly mounting a roughly ellipsoidal plug of a readily compressible foam plastic material to the upper squeeze plate so as to be received into the riser sleeve to seal the same as sand is injected into the mold cavity of the mold machine. The compressible plug is advanced into the riser sleeve while maintaining a sealed relationship as the squeeze plate compresses the sand to form the mold.

The plug is withdrawn from within the riser sleeve as the mold is retracted from the upper squeeze plate, and ultimately the plug is drawn completely clear in the fully lowered position of the mold. The plug is reusable over repeated mold making cycles.

DETAILED DESCRIPTION

In the following detailed description, certain specific terminology will be employed for the sake of clarity and a particular embodiment described in accordance with the requirements of 35 USC 112, but it is to be understood that the same is not intended to be limiting inasmuch as the invention is capable of taking many forms and variations within the scope of the appended claims.

Figure 1:
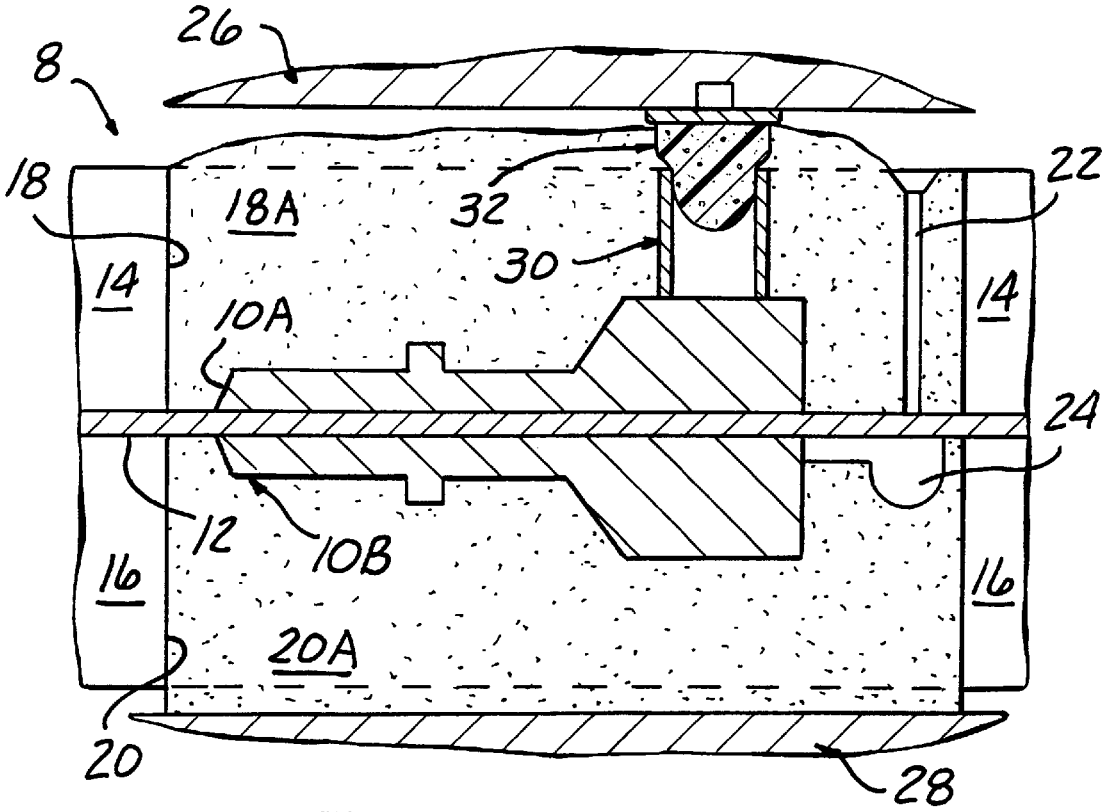
FIG. 1 is a sectional diagrammatic view of a mold making machine showing a sectional view of the riser sleeve plug according to the present invention.

Referring to the drawings and particularly FIG. 1, a mold machine 8 includes patterns 10A and 10B and pattern board 12, shown in position within a cavity 18 of a cope flask 14 and a cavity 20 of a drag flask 16.

The mold machine 8 in which the mold making is to be carried out includes conventional upper fixed squeeze plate 26 and upwardly movable lower squeeze plate 28.

A volume of sand 18A is injected in cavity 18 of the cope flask 14 and a volume of sand 20A in the cavity 20 of the drag flask 16.

A conventional riser sleeve 30 is disposed against the upper portion of the pattern 10A, extending upwardly partially through the cope cavity sand volume 18A.

Figure 5:
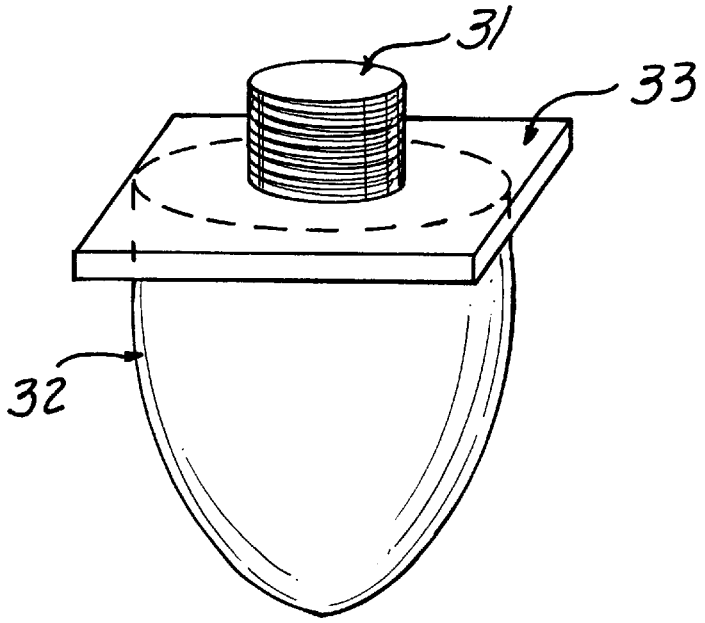
FIG. 5 is a perspective view of the riser sleeve plug.

A semi-ellipsoidal plug 32 (see FIG. 5) having an outwardly curved tapered shape is fixedly mounted to the upper squeeze plate 26 by a threaded stem 31 fixed to mounting plate 33 to project downwardly into the riser sleeve 30. The plug 32 is constructed of a resilient flexible material such as a polyurethane foam or similar material.

According to the concept of the present invention, the downwardly projecting end of the plug 32 is sealingly received into the upper end of riser sleeve 30. The projecting end is of smaller diameter than the inside of the riser sleeve to be received therein prior to injection of sand, while the larger diameter of the remaining portions causes compression of plug material against the riser sleeve 30 inside to prevent the entrance of sand into the sleeve 30.

Conventional means (not shown) are provided for forming a down sprue 22 and in gate 24.

The volume of sand 18A in the cavity cope flask 14 and the volume of sand 20A in the cavity 20 of the drag flask 16 are both compacted by upward movement of the lower plate 28 until the upper and lower plates 26, 28 approach contact with the cope flask 14 and drag flask 16 respectively.

Figure 2:
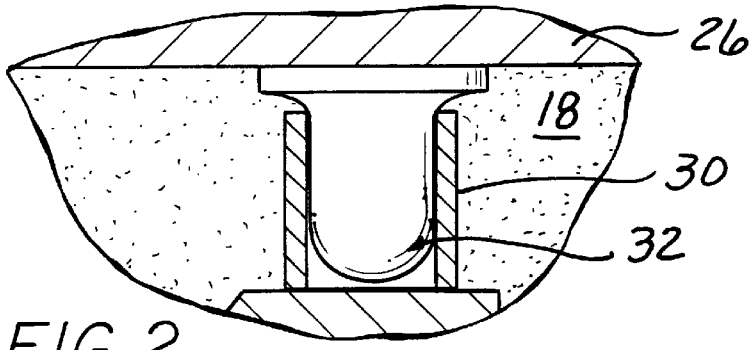
FIG. 2 is an enlarged sectional view through the riser sleeve with the plug in an advanced position.
Figure 3:
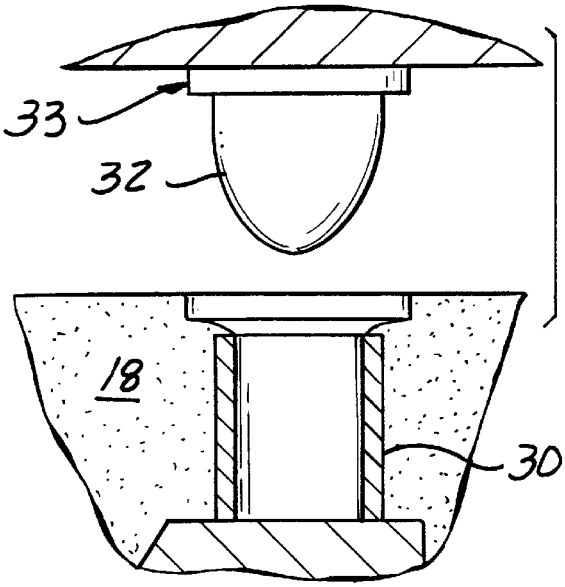
FIG. 3 is a fragmentary sectional view of the mold machine and mold components showing the plug in the withdrawn position.

During mold making, the plug 32 is driven down into the riser sleeve 30 as the mold sand is compacted, reaching an advanced position shown in FIG. 2. The compression of the plug 32 maintains a sealing fit within the riser sleeve 30 as the plug 32 is driven into the riser sleeve 30. This maintains a sealed environment within the riser sleeve 30 preventing any sand or dirt from entering the mold cavity.

When the lower squeeze plate 28 descends, the cope 14 and drag 16 are lowered so that the plug 32 is withdrawn from the riser sleeve 30.

Figure 4:
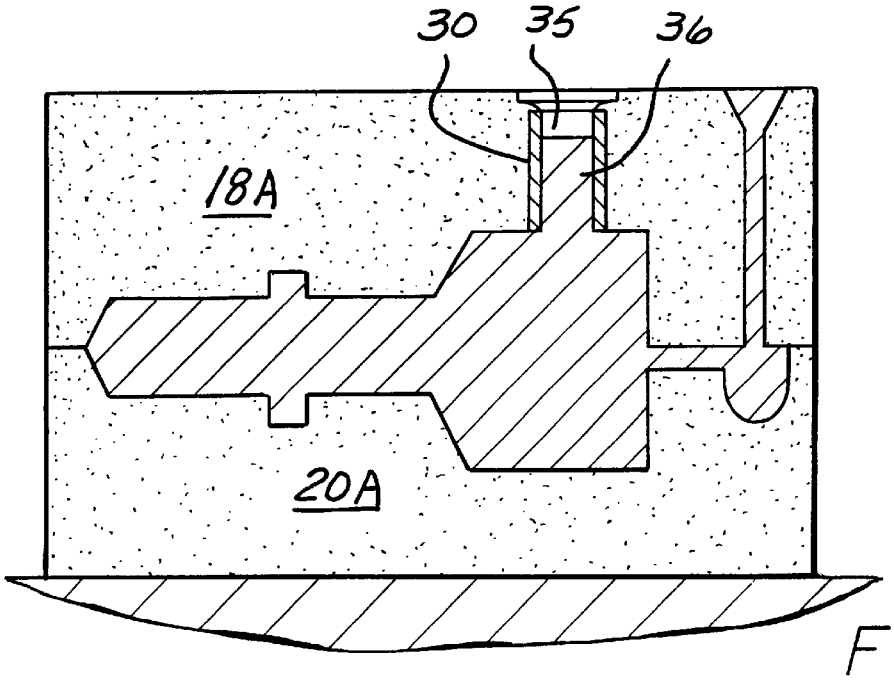
FIG. 4 is a sectional view of a mold made according to the process according to the invention, with molten metal poured into the cavity and partially filling the riser sleeve.

Referring to FIG. 4, during casting, the metal 36 rises from the mold cavity into the open riser sleeve 30, opening into an open riser 35, allowing the riser to be topped off with additional metal, as needed.

The plug 32 may be left in place to be reused over a number of mold making cycles, thus eliminating the need for installation of the plug for each mold, or the separately form the riser.

What is claimed is:

1. A method of forning an open riser in a mold in a mold making machine having an upper squeeze plate for compressing sand in a cope flask included in said machine, said upper squeeze plate being relatively movable towards and away from said cope flask, comprising the steps of installing a riser sleeve in said cope flask, said riser sleeve extending against a mold pattern also included in said machine;

fixing a plug constructed of a resiliently compressible material to project downwardly from said upper squeeze plate so as to be moved therewith, shaping said plug to have an increasing diameter from a lower tip able to be received inside said riser sleeve to a diameter substantially greater than the inside of said riser sleeve so as to be partially press fitted therein with a portion thereof projecting above said upper end of said riser sleeve and the level of sand in said cope flask;

pushing said plug into said riser sleeve and thereafter resiliently compressing said plug by continuing relative movement of said upper squeeze plate and said cope flask together to compress sand in said cope flask; and withdrawing said plug from said riser sleeve by relatively moving said upper squeeze plate and said cope flask apart, said plug resiliently restored to its original shape as said plug is withdrawn from said riser sleeve, whereby an open riser is produced.

2. The method according to claim 1 further including the step of shaping said plug to have an outwardly curved shape to be sealingly interfit within said riser sleeve as said plug is pushed into said riser sleeve and resiliently compressed therein.

3. The method according to claim 1 further including the step of constructing said plug of soft polyurethane foam so that said plug is resiliently compressed as said plug is advanced into said riser sleeve.

4. In a mold making machine having upper and lower squeeze plates for compressing a volume of sand in a cope flask against a mold pattern, said upper squeeze plate and cope flask being relatively movable to compress said volume of sand in said cope flask, a riser sleeve extending upwardly from said pattern, the improvement comprising a resiliently compressible plug fixed to said upper squeeze plate to be held fixed with respect to said upper squeeze plate as said squeeze upper plate and said cope flask arc moved relatively together to compress said volume of sand, and are moved relatively in a direction to be separated, said plug located to be received within said riser sleeve as said upper squeeze plate and cope flask are relatively moved in a direction towards each other, said plug of a tapering diameter from a small diameter end able to be received within said riser sleeve to a diameter substantially greater than the inside diameter of said riser sleeve, said plug resiliently compressed within said riser sleeve to maintain a sealing engagement with continued relative movement of said upper squeeze plate and said cope flask towards each other in compressing said volume of sand, said plug withdrawn from said riser sleeve and restored in shape with continued relative separating movement of said upper squeeze plate and said cope flask.

* * * * *

UNITED STATES PATENT AND TRADEMARK OFFICE

CERTIFICATE OF CORRECTION

PATENT NO. : 6,189,599 B1
DATED : February 20, 2001
INVENTOR(S) : Paul E. Hanna

It is certified that error appears in the above-identified patent and that said Letters Patent is hereby corrected as shown below:

Column 1,
Line 37, after "riser" delete "tube", insert therefor -- plug --.

Column 3,
Line 5, after "mold, or" delete "the", insert therefor -- to --.

Signed and Sealed this

Twelfth Day of March, 2002

*Attest:*

*Attesting Officer*

JAMES E. ROGAN
*Director of the United States Patent and Trademark Office*